US006377761B1

(12) United States Patent
Nichols

(10) Patent No.: US 6,377,761 B1
(45) Date of Patent: Apr. 23, 2002

(54) METHOD TO EVALUATE THE CLEANING PERFORMANCE OF BRUSH CLEANERS IN AN ELECTROPHOTOGRAPHIC PRINTER

(75) Inventor: Stephen John Nichols, Walworth, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/687,097

(22) Filed: Oct. 16, 2000

(51) Int. Cl.[7] ..... G03G 21/00; G03G 15/00
(52) U.S. Cl. ..... 399/34; 399/15
(58) Field of Search ..... 399/9, 15, 24, 399/34, 343, 353

(56) References Cited

U.S. PATENT DOCUMENTS 5,546,177 A * 8/1996 Thayer ..... 399/353
5,606,721 A * 2/1997 Thayer et al. ..... 399/34
5,652,945 A 7/1997 Thayer et al. ..... 399/34
5,884,118 A * 3/1999 Mestha et al. ..... 399/15
5,887,223 A * 3/1999 Sakai et al. ..... 399/15 X
5,903,797 A * 5/1999 Daniels et al. ..... 399/34

* cited by examiner

*Primary Examiner*—Sandra Brase
(74) *Attorney, Agent, or Firm*—Perman & Green, LLP

(57) ABSTRACT

A method for measuring a width of a contact zone between a surface, having movement, and a cleaner brush, having a detoning member, the surface having a toner image thereon, the contact zone having particles of the toner image removed from the surface, 'comprising the steps of developing the toner image on the surface, the toner image having sufficient width to overlap the cleaner brush; moving the toner image into direct alignment with the cleaner brush; stopping the movement of the surface; rotating the cleaner brush against the surface to remove the toner image from the surface in the contact zone; moving the toner image out of direct alignment with the cleaner brush; transferring the toner image from the surface onto a substrate; fusing the toner image on the substrate; measuring the entire width extending in the process direction of the cleaned areas; and converting the measurement of the width for diagnostic analysis and process control.

14 Claims, 5 Drawing Sheets

METHOD TO EVALUATE THE CLEANING PERFORMANCE OF BRUSH CLEANERS IN AN ELECTROPHOTOGRAPHIC PRINTER

BACKGROUND OF THE INVENTION

1. Field of the Invention

This invention relates to an electrophotographic printing machine and more particularly concerns a method for the measurement of a cleaning brush nip width for process control and/or diagnostics as can be used in such a printing machine.

2. Description of the Prior Art

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are thereafter heated to permanently affix the powder image to the copy sheet. The copy sheets are then sorted and collected into sets of copy sheets. The copy sheets of each set are then secured to one another and stacked for presentation to the machine operator.

In view of the extensive use of toner powder in a typical use of an electrophotographic printing machine, a major issue within an electrophotographic printing apparatus is cleaning. Cleaning within such an apparatus is typically accomplished by the use of a rotating cleaning brush. One of the significant factors in the performance of a cleaning brush in an electrophotographic printing machine environment is the number of brush fiber tips which are available to contact toner entering the zone formed by the interference of the brush to the photoreceptor. The higher the number of available fibers on the brush (fiber strikes) to clean, the better the cleaning and the more robust the cleaner will be to stress inputs and environments. Fiber strikes are a function of the brush diameter, brush speed and brush to photoreceptor interference (i.e. BPI). At any point in time only the speeds and interference can be varied. Over time, however, the diameter of the brush will shrink with usage. This is due to the mechanical set of the brush fibers due to repeated compression in the photoreceptor nip and, if present, detoning roll or flicker bar interferences. Additionally, the brush diameter will decrease due to the accumulation of toner within the brush. (Toner accumulated near the core of the brush holds the fibers in deflected positions.)

Verification of the interference of a new brush to a photoreceptor or to determine the shrinkage of a used brush (and the loss of fiber strikes) is often determined by measuring the width of the cleaning brush nip(s) to the photoreceptor. The nip width was manually measured directly from the photoreceptor surface or from a tape transfer that provided a permanent record of the testing conditions when the brush diameter was known. A simple equation relates the nip width to the brush diameter and the interference, (1/2 Dia.) . sup. 2=(1/2 Dia.−BPI). sup. 2+(1/2 Nip Width). sup. 2. Unfortunately, the present procedure for measuring the nip width procedure is too dirty and complicated to be used as a field service procedure.

It has been proposed to avoid the disadvantages described above to use an ESV or ETAC (BTAC or TAC) sensor to measure the width of the image on the photoconductor surface, i.e. while the image is still in loose particulate toner form. However, an ESV or BTAC sensor looks at only a narrow band around the photoreceptor (BTAC 3 mm and ESV about 12–15 mm).

The following disclosures may be relevant to various aspects of the present invention and may be briefly summarized as follows:

U.S. Pat. No. 5,450,186 to Lundy discloses a flexible cleaner brush belt that increases brush belt life by flexing away from the photoreceptor when not in use. The flexible belt is lifted away from contact with the photoreceptor and placed back into contact with the photoreceptor by a camming device. A camming device attached to linkages, increases the diameter of the flexible brush belt to lift the brush belt away from contact with the imaging surface. The camming device urges the belt brush back into contact with the imaging surface by decreasing the diameter of the brush belt. This movement of the brush belt increases the brush belt life and does not cause print quality defects, excessive toner clouding, or loss of machine productivity.

U.S. Pat. No. 5,381,218 to Lundy discloses a conductive flexible cleaner brush belt having a plurality of detoning stations to remove particles from the brush fibers. At least one of the rollers about which the flexible belt brush is mounted has a small diameter for spreading the brush fibers apart. This spreading of the fibers creates a node affect as the fibers rebound, adjacent fibers open creating a moving node affect. This note affect facilitates detoning of the brush by an air vacuum as air removes the particles from the brush fibers.

U.S. Pat. No. 5,652,945 discloses a method to evaluate the cleaning performance of brush cleaners by measuring the brush to photoreceptor nip width (e.g. cleaning footprint or contact zone) using an ESV sensor or ETAC sensor. This nip width measurement is automatically made using one of the sensing devices and is a measurement of only a portion or part of the width of the loose toner particle image on the photoreceptor. The nip width measurement is converted into diagnostic information using a software algorithm or similar mode of conversion. The diagnostic information can be used in a variety of ways such as a diagnostic tool for a technical representative to warn against the end of brush life, to adjust cleaner biases for automatic changes in setup to achieve better cleaning, to predict brush replacement, to correct brush BPI (i.e. brush to photoreceptor interference) for an under or over engaged brush. In accordance with the advantages of the present invention, transferring the image to paper and fusing the image enables an automated evaluation using a scanner. The advantage of using a scanner is the ability to evaluate the entire width of the cleaner to the photoreceptor interface to find isolated areas of the brushes that have failed or an inboard to outboard variation in the cleaning nip which indicates a possible mechanical problem in controlling a uniform gap between the cleaner and the photoreceptor.

SUMMARY OF THE INVENTION

In accordance with the features of the present invention, there is provided a method for measuring a width of a contact zone between a surface, having movement, and a cleaner brush, having a detoning member, the surface having a toner image thereon, the contact zone having particles of the toner image removed from the surface, comprising: developing the toner image on the surface, the toner image having sufficient width to overlap the cleaner brush; moving the toner image to be directly aligned with the cleaner brush; stopping the movement of the surface; rotating the cleaner brush against the surface to remove the toner image from the surface in the contact zone; moving the toner image out of direct alignment with the cleaner brush; transferring the toner image from the surface onto a substrate; fusing the toner image on the substrate; measuring the entire width extending in the process direction of the cleaned areas of the fused image; and converting the measurement of the width for diagnostic analysis and 'process control. Measuring the entire width of the fused image in accordance with the features of the present invention comprises using a scanner for the measurement.

BRIEF DESCRIPTION OF THE DRAWINGS

Other features of the present invention will become apparent as the following description proceeds and upon reference to the drawings, in which.

DETAILED DESCRIPTION OF THE PREFERRED EMBODIMENT

For a general understanding of a color electrostatographic printing or copying machine in which the features of the present invention may be incorporated, reference is made to U.S. Pat. Nos. 4,599,285 and 4,679,929, whose contents are herein incorporated by reference, which describe the image on image process having multi-pass development with single pass transfer. Although the cleaning evaluation method of the present invention is particularly well adapted for use in a color electrostatographic printing or copying machine, it should become evident from the following discussion, that it is equally well suited for use in a wide variety of devices and is not necessarily limited to the particular embodiments shown herein.

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

Figure 1:
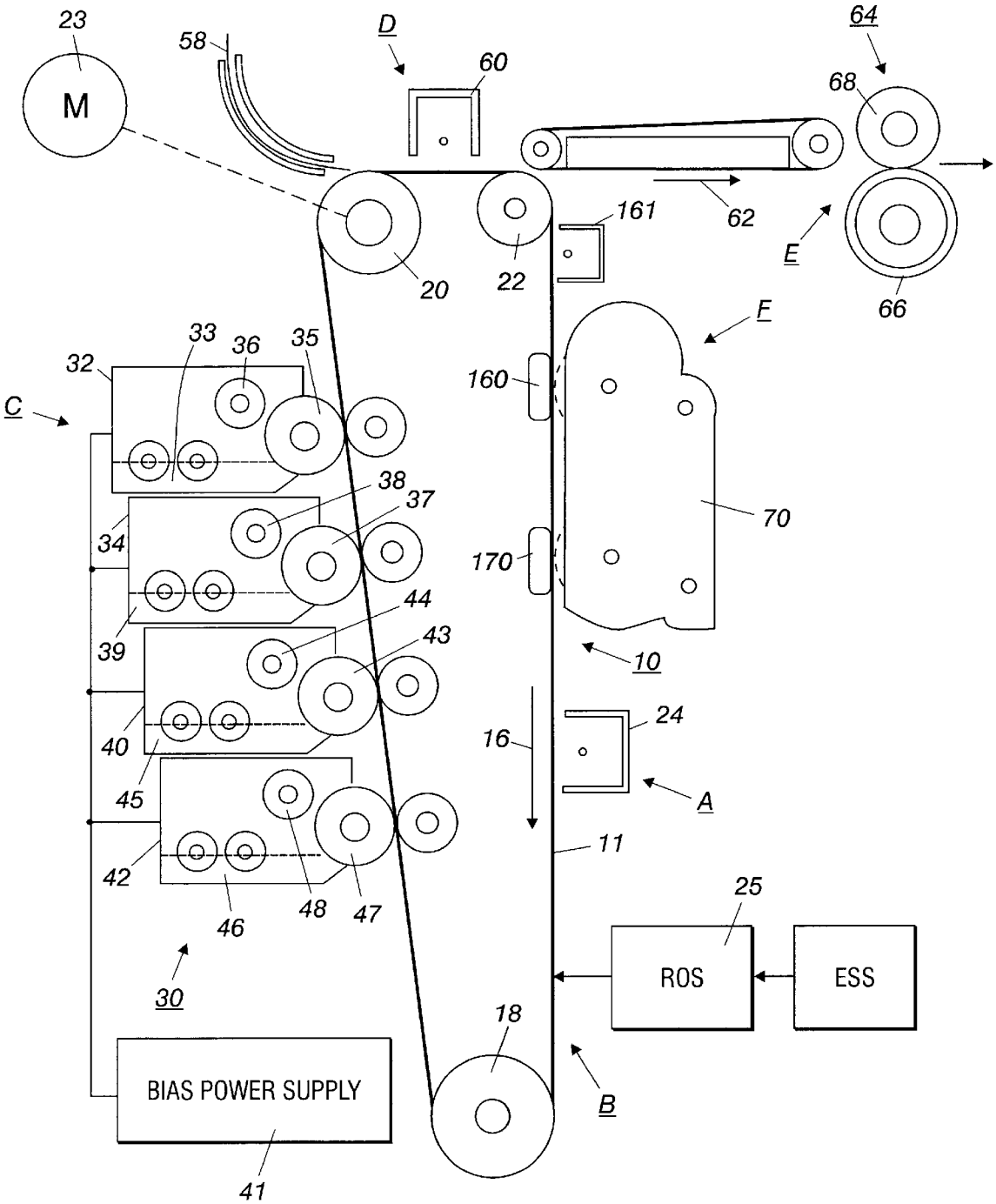
FIG. 1 is a schematic elevational view depicting an illustrative electrophotographic printing machine in which the method as described in the present invention can be used.

FIG. 1 illustrates a reproduction machine that copies an original document. Although the principles of the present invention are well suited for use in such electrophotographic copiers, they are also well suited for use in other printing devices, including electrophotographic printers.

A reproduction machine, from which the present invention finds advantageous use, utilizes a charge retentive member in the form of the photocodnuctive belt 10 consisting of a photoconductive surface and an electrically conductive, light transmissive substrate mounted for movement past charging station A, and exposure station B, developer stations C, transfer station D, fusing station E and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Motor 23 rotates roller 18 to advance belt 10 in the direction of arrow 16. Roller 20 is coupled to motor 23 by suitable means such as a belt drive.

As can be seen by further reference to FIG. 1, initially successive portions of belt 10 pass through charging station A. At charging station A, a corona device such as a scorotron, corotron or dicorotron indicated generally by the reference numeral 24, charges the belt 10 to a selectively high uniform positive or negative potential. Any suitable control, well known in the art, may be employed for controlling the corona device 24.

Next, the charged portions of the photoreceptor surface are advanced through exposure station B. At exposure station B, the uniformly charged photoreceptor or charge retentative surface 10 is exposed to a laser based input and/or output scanning device 25 which causes the charge retentive surface to be discharged in accordance with the output from the scanning device (for example a two level Raster Output Scanner (ROS)).

The photoreceptor, which is initially charged to a voltage, undergoes dark decay to a voltage level. When exposed at the exposure station B it is discharged to near zero or ground potential for the image area in all colors.

At development station C, a development system, indicated generally by the reference numeral 30, advances development materials into contact with the electrostatic latent images. The development system 30 comprises first 42, second 40, third 34 and fourth 32 developer apparatuses. (However, this number may increase or decrease depending upon the number of colors, i.e. here four colors are referred to, thus, there are four developer housings). The first developer apparatus 42 comprises a housing containing a donor roll 47, a magnetic roller 48, and developer material 46. The second developer apparatus 40 comprises a housing containing a donor roll 43, a magnetic roller 44, and developer material 45. The third developer apparatus 34 comprises a housing containing a donor roll 37, a magnetic roller 38, and developer material 39. The fourth developer apparatus 32 comprises a housing containing a donor roll 35, a magnetic roller 36, and developer material 33. The magnetic rollers 36, 38, 44, and 48 develop toner onto donor rolls 35, 37, 43 and 47, respectively. The donor rolls, 35, 37, 43, and 47 then develop the toner onto the imaging surface 11. It is noted that development housings 32, 34, 40, 42, and any subsequent development housings must be scavengeless so as not to disturb the image formed by the previous development apparatus. All four housings contain developer material 33, 39, 45, 46 of selected colors. Electrical biasing is accomplished via power supply 41, electrically connected to developer apparatuses 32, 34, 40 and 42.

Sheets of substrate or support material 58 are advanced to transfer D from a supply tray, not shown. Sheets are fed from the tray by a sheet feeder, also not shown, and advanced to transfer D through a corona charging device 60. After transfer, the sheet continues to move in the direction of arrow 62, to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a back-up roller 68 with the toner powder images contacting fuser roller 66. In this manner, the toner powder image is permanently affixed to the sheet.

After fusing, copy sheets are directed to a catch tray, not shown, or a finishing station for binding, stapling, collating, etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually. Residual toner and debris remaining on photoreceptor belt 10 after each copy is made, may be removed at cleaning station F with a brush or other type of cleaning system 70. Backers 160 and 170 are located directly opposed from the cleaner brushes on the opposite side of the photoreceptor 10. A preclean corotron 161 is located upstream from the cleaning system 70.

The various machine functions are regulated by a controller. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the gates depending upon the mode of operation selected.

In the present invention, an automated measurement of cleaning brush nip width is disclosed for use in copiers and printers. The measurement of the nip width indicates the diameter of the brush, after some period of use, which can be used to determine the fiber strikes available and the potential life remaining in the brush. The automated procedure, of the present invention, allows the technical representative (or equivalent) to diagnose the cause of a cleaning failure.

Figure 2A:
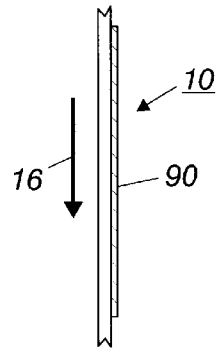
FIG. 2, (i.e. 2A, 2B and 2C) illustrate, sequentially, an elevational schematic view of a developed toner patch on a photoreceptor (FIG. 2A), cleaning a nip width of the toner patch with a cleaner (FIG. 2B) and using the present invention, measuring the nip width cleaned from the toner patch by the cleaner (FIG. 2C)
Figure 2B:
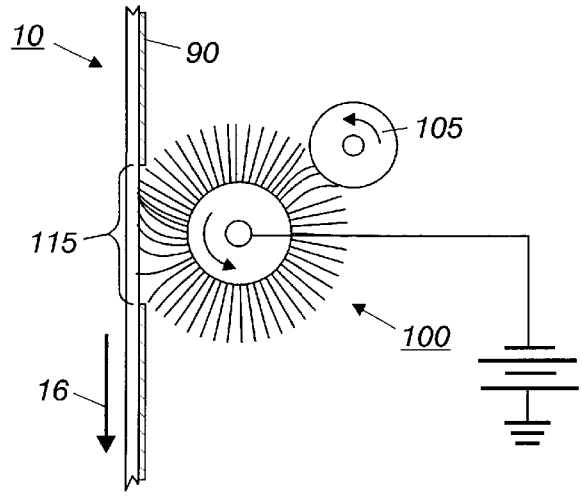
Figure 2C:
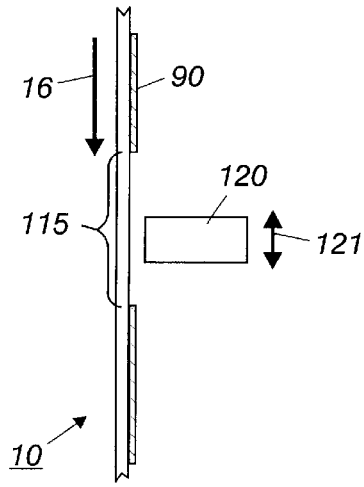

Reference is now made to FIG. 2 i.e., (FIGS. 2A, 2B and 2C) which shows sequentially the operation of the present invention to measure cleaner nip width. In the present invention, to implement nip width 115 measurement, the cleaner (e.g. brush or roller) and photoreceptor 10 must be independently driven. The nip width measurement is made when the electrostatographit'printer is in a special mode, such as during cycle up or cycle out by positioning the fused image in a scanner.

With continuing reference to FIG. 2 (i.e. FIGS. 2A, 2B and 2C), the following basic procedure is required for measurement by the present invention. First, a toner patch 90 of sufficient width to overlap the brush 100 (or brushes or other like cleaner) is developed on the photoreceptor 10 surface. (This toner patch 90 has a predetermined length, in that the toner patch is long enough to span the brush nips.) (See FIG. 2A) Next, the toner patch is moved under the brush. The toner of the toner patch must not be removed by the brush until the photoreceptor 10 is stationary. Next, a bias voltage is applied to the brushes and then the brushes are rotated against the stationary photoreceptor. At this stage the toner image is transferred from the photoconductive surface onto a substrate such as paper. Thereafter, the toner image on the substrate is fused and measuring of the entire width as extending in the process direction (See FIG. 3) of the cleaned areas of the fused image begins. The measuring is accomplished in accordance with the features of the present invention by a scanner. 120, i.e. an image scan module capable of moving in the directions of arrow 121. In accordance with the features of the present invention the scanner 120 evaluates the image on the paper substrate.

Specifically, the scanner digitizes the whole image on the paper substrate enabling the entire width of the clean areas to be evaluated insuring that isolated bands are seen. Additionally, the scanner can look for inboard to outboard nonconformity (indicates a possible docking issue between cleaner and photoreceptor module) or for now, a parallelism between cleaner brushes (i.e. indicates a problem in the first or both cleaner brushes). A very skilled service person can use his or her eyes to make the same evaluation. Then the toner patch is removed from contact with the cleaner brush. The nip width value attained using the present invention, is compared to predetermined nip width values for the cleaning brush to determine if a failure has occurred with the cleaning brush. The predetermined nip width values are devised based upon brush characteristics including brush diameter and photoreceptor interference. For example, a 30 mm diameter brush has a nominal nip width equal to 15 mm (2 mm BPI), a minimum nip width equal to 10.8 mm (1 mm BPI) and a maximum nip width equal to 16.6 mm (2.5 mm BPI). A cleaner brush failure, for these parameters, is deemed to occur when the measured nip width falls outside of the predetermined 10.8 mm to 16.6 mm range (i.e. outside of the minimum/maximum range values).

Finally, the nip width measurement is converted into information that can be used to determine the preventive or repair actions needed in the machine. The nip width value provides a useful diagnostic tool for a technical representative that provides an end of brush life indication or localized brush failure. Software algorithms are but one method of converting nip width measurements into useful diagnostic information. Another method would be a manual eyeball evaluation by a fairly well experienced service person.

Figure 3:
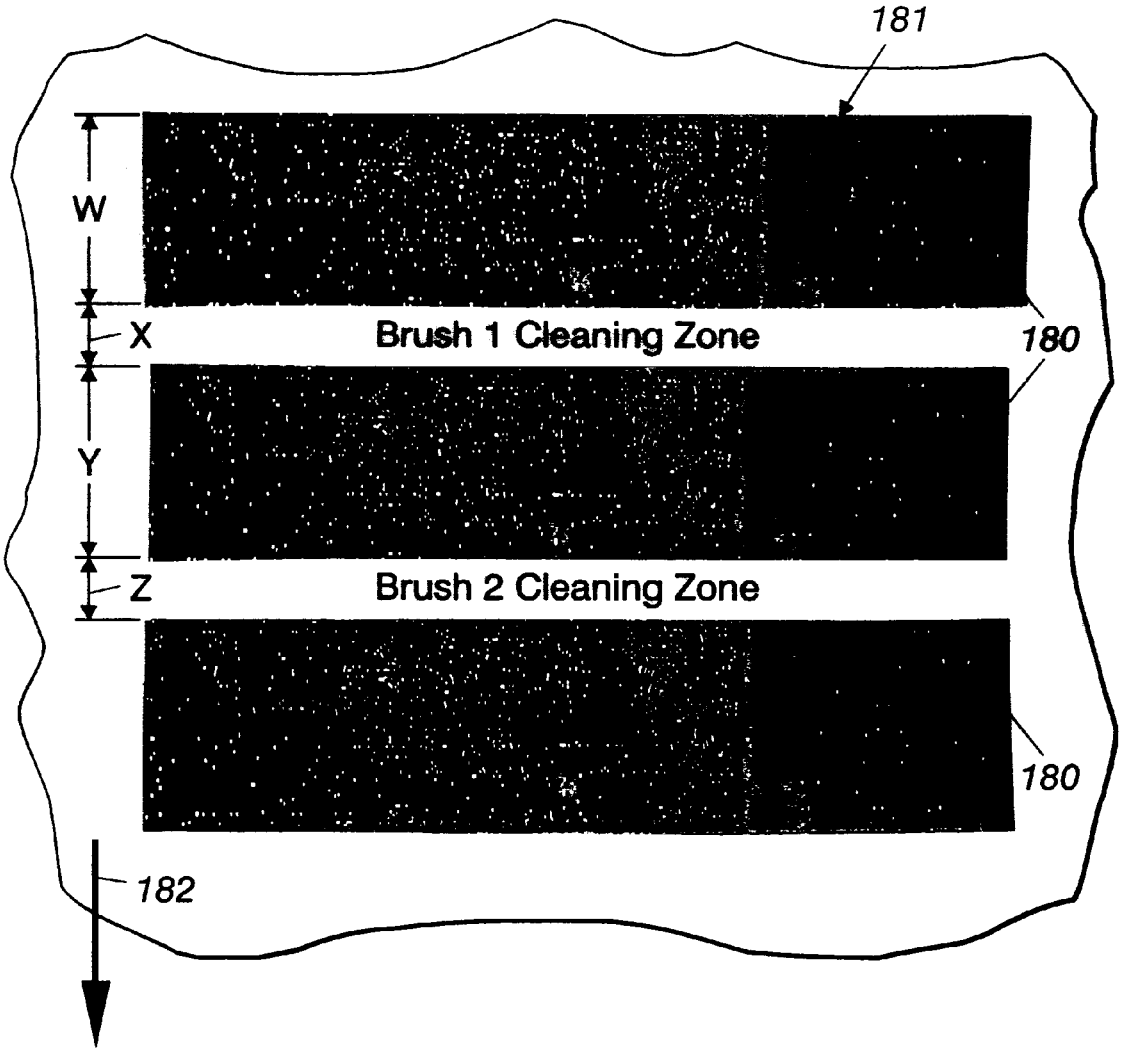
FIG. 3 is a topical schematic view of a developed and fused toner patch having two nip widths of toner removed from the patch by two different cleaning brushes.

There is illustrated in FIG. 3 a developed, transferred and fused toner patch 180 on a paper substrate that is subject to cleaning by two brushes. There is shown a lead edge of the paper 181 followed by a width w of fused toner. W represents the width dimension from the lead edge of the paper sheet 181 to the start of toner background density in the first cleaned area. x represents the width dimension from the start of background density in the first cleaned area by the first rotating brush to the end of background density in the first cleaned area. Y represents the width dimension from the trail edge of background density in the first cleaned area to the start of background density in the second cleaned area. Z represents the width dimension from the start of background density in the second cleaned area to the end of background density in the second cleaned area. The second cleaned area is cleaned by a second rotating brush. The direction of movement of the paper sheet is shown by arrow 182.

Figure 4:
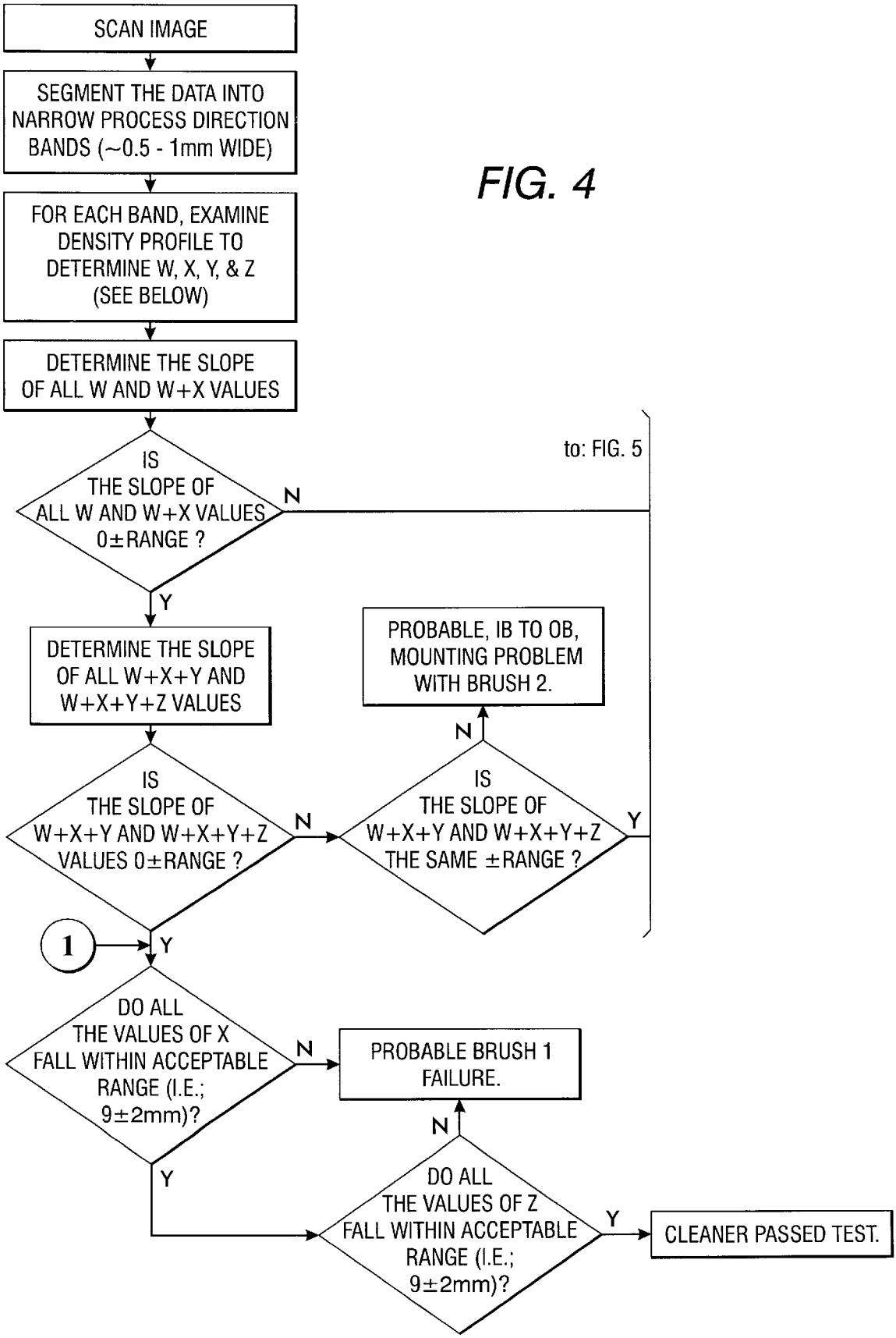
FIGS 4 and 5 are a flow chart illustrating a method in accordance with the features of the present invention for converting the measurement of the width of fused toner images as illustrated in FIG. 3 for diagnostic analysis and process control.
Figure 5:
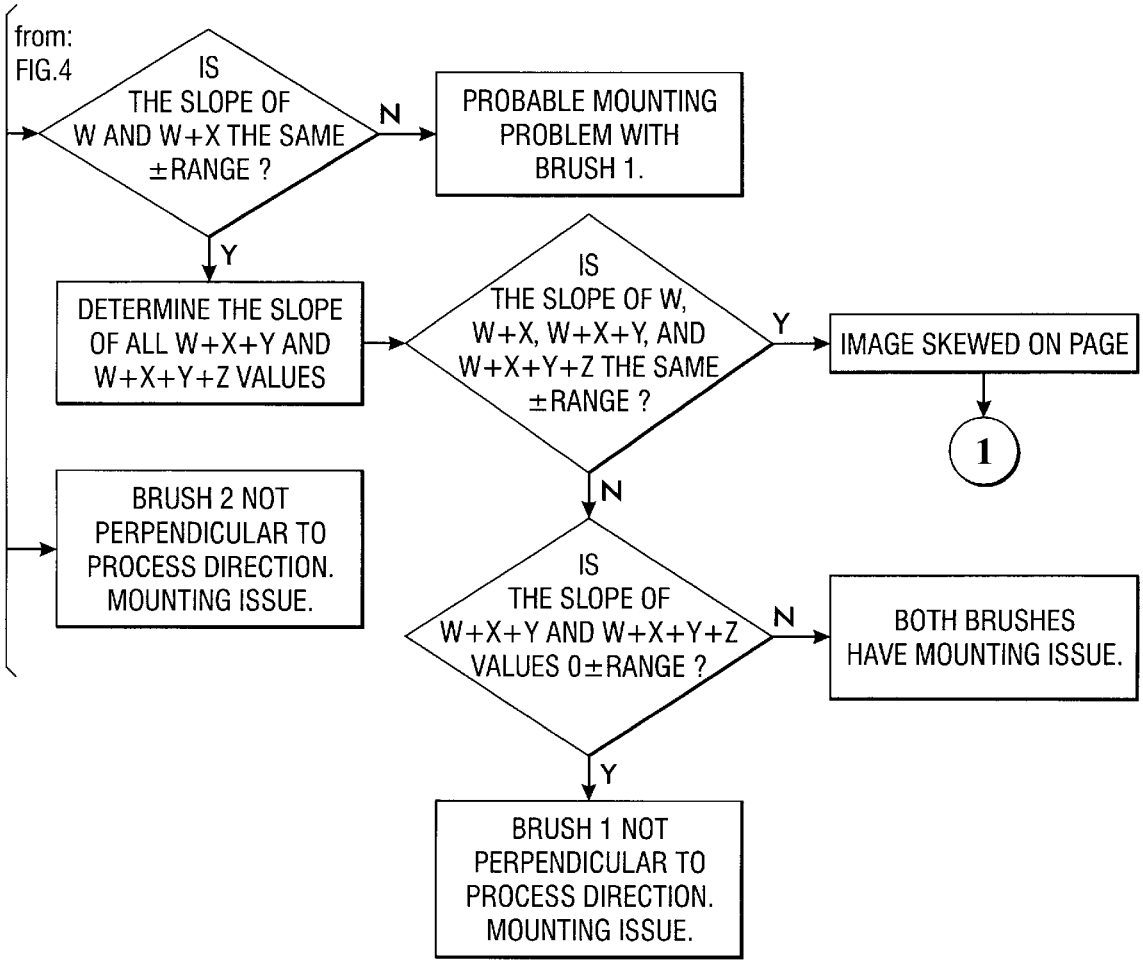

The flow chart illustrated in FIGS. 4 and 5 forms the basis for a software algorithm that enables a printing machine such as an electrophotographic printer to determine if the cleaner is the source of streaks on prints produced by the printer. The ability to evaluate the cleaner diagnostic print is a key enabler of the printer to be able to diagnose the cause of streak type print defects by itself. If the printer can determine the root cause of streaks, a low cost service person can be dispatched to repair the cleaner because the trouble-shooting has been accomplished by the machine, leaving only the part replacement for the service person, e.g. change the brush.

This software algorithm can be used with single or multiple brush cleaners in an electrophotographic printer. A two brush diagnostic image as illustrated in FIGS. 3, 4 and 5 will have a halftone with two cross process zero (low) density bands. The machine's scanner scans the image. The algorithm examines the scanned image by looking at the image in the process, i.e. the direction of movement of the paper 182 (See FIG. 3). The algorithm starts at the edge of the image 181 (FIG. 3) and looks at the image in 0.5 mm bands (exact value must be determined by using the algorithm on real prints). For each band the algorithm will locate the position on the paper sheet where the first brush first started to effectively clean the image. The position where effective cleaning stops is then determined. The positions of the effective start and stop of cleaning with brush two is also determined. The delta between the effective start and stop of cleaning is the width of the footprint for each of the process direction bands. The resulting footprint widths for each band for brush one and two are put in arrays. The arrays are examined to find locations where the footprint violates the minimum footprint needed for effective cleaning. The location on the image where the footprint is the smallest is compared to the location(s) in a streak diagnostic image the scan diagnostics located a possible cleaner induced streak. In a HSD system, (i.e. streaks caused by a cleaner failure will be in all separations. If the position of the streaks in the streak(s) diagnostic image match the position(s) of where the footprint violates the minimum footprint needed for effective cleaning, the root can be assumed to be a cleaner failure. The corresponding brush or cleaner can be changed by a low skill service person.

It is noted that variations may be made to this basic rocedure. The following examples are three such ariations in the present invention. After developing a oner patch 90 of sufficient width to overlap the brush 100 (or brushes) on the photoreceptor 10 surface, the toner patch on the moving photoreceptor is moved under or into alignment with the cleaner brush (or brushes) which has been retracted away from the photoreceptor. Next, the brush is engaged with the stationary photoreceptor and rotated against the photoreceptor. Then the brush is once again retracted so that the toner patch is not disturbed before a measurement can be made of the nip width. Then the measurement and conversion steps previously described, occur at this time.

Referring to FIG. 2B, an alternate embodiment of the present invention, is to develop a toner patch 90 of sufficient width to overlap the brush 100 (or brushes) on the photoreceptor 10 surface. The toner patch 90 is then moved under the brush and the brush is biased electrostatically to the same polarity as the toner to prevent cleaning of the toner by the non-rotating brush or brushes. In the next step of this embodiment, the bias is removed from the brush and the brush is then rotated against the stationary photoreceptor 10. Next, during removal of the toner patch from under the electrostatic brush is once again biased to the same polarity as the toner so as not to remove toner from the toner patch 90 by the brush before a measurement is made. The measurement and conversion steps described above would then occur at this point.

Another embodiment of the present invention is to develop the toner patch 90 of sufficient width to overlap the brush 100 (see FIG. 2A) (or brushes—see FIG. 1) on the photoreceptor surface. Then, the brush is stopped from rotating and no bias is applied to the brush as the toner patch is moved under the cleaning brush or brushes. The brush fibers dragging through the toner pile will disturb but not remove the toner with the exception that some of the lead edge of the toner patch may be removed. The brushes are then rotated against the stationary photoreceptor while the detoning device (e.g. air, flicker bar, detoning roll 105 (see FIG. 2B) is disabled. Next the toner patch is removed from alignment or under the cleaner brush while the brush is not rotating nor having a biased applied to the brush. The poor detoning of the stationary brush (i.e. because the detone has been disabled) prevents significant disturbance of the toner patch in the nip. The measurement and conversion steps described above would then occur at this point.

It is, therefore, apparent that there has been provided in accordance with the present invention, a measurement of cleaning brush nip that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A method for measuring a width of a contact zone between a photoreceptor, having movement, and a non-retracting cleaner brush, having a detoning member, the photoreceptor having a toner image thereon, the contact zone having particles of the toner image removed from the photoreceptor, comprising:

developing the toner image on the surface, the toner image having sufficient width to overlap the cleaner brush;

moving the toner image into direct alignment with the cleaner brush;

stopping the movement of the photoreceptor and then resynchronizing to help get the image onto a substrate;

rotating the cleaner brush against the photoreceptor to remove the toner image from the photoreceptor in the contact zone;

moving the toner image out of direct alignment with the cleaner brush;

transferring the toner image from the photoreceptor onto the substrate;

fusing the toner image on said substrate;

measuring the entire width extending in the process direction of the cleaned areas on said fused image; and converting the measurement of said width for diagnostic analysis and process control.

2. A method as claimed in claim 1 wherein said measurement of the entire width is automatic.

3. A method as claimed in claim 2 wherein the step of measuring the entire width automatically comprises using a scanner to measure the entire width of said fused image.

4. A method as recited in claim 3, wherein said scanning device comprises an optical sensor array.

5. A method as recited in claim 3, wherein the step of using said scanning device comprises measuring the difference in reflectivity of said fused image between the areas on the substrate corresponding to the cleaned and non-cleaned areas of said image.

6. A method as recited in claim 1, wherein the step of moving said toner image into direct alignment with said cleaner brush comprises the step of retracting said cleaner brush from said photoreceptor.

7. A method as recited in claim 1, wherein the step of rotating said cleaner brush against said photoreceptor comprises the step of engaging said cleaner brush with said photoreceptor having said toner image thereon.

8. A method as recited in claim 7, wherein the step of moving said toner image out of direct alignment with said cleaner brush comprises the steps of:

retracting said cleaner brush away from contact with said photoreceptor; and restarting movement of said photoreceptor to move said image out of direct alignment with said cleaner brush.

9. A method as recited in claim 1, wherein the step of moving said toner image into direct alignment with said cleaner brush comprises the steps of:

stopping rotation of said cleaner brush; and biasing said cleaner brush to the same polarity as said toner image to prevent removal of said toner image by said cleaner brush in a non-rotating mode.

10. A method as recited in claim 9, wherein the step of rotating said cleaner brush against said photoreceptor comprises the steps of:

rotating said cleaner brush; and removing the bias on said cleaner brush during rotation of said cleaner brush against said photoreceptor to remove said toner image in said contact zone.

11. A method as recited in claim 10, wherein the step of moving the toner image out of direct alignment with said cleaner brush comprises the steps of:

biasing said cleaner brush to the same polarity as said toner image; and restarting movement of said photoreceptor to move said cleaner brush out of direct alignment with said image.

12. A method as recited in claim 1, wherein the step of moving the toner image includes the step of stopping rotation of said cleaner brush.

13. A method as recited in claim 12, wherein the step of rotating the cleaner brush against the photoreceptor comprises the step of disabling the detoning member adjacent to the cleaner brush for removing the particles cleaned from the photoreceptor, from the cleaner brush.

14. A method as recited in claim 13, wherein the step of moving the toner image out of direct alignment with the cleaner brush comprises brush the steps of:

stopping rotation of the cleaner brush; and restarting movement of the photoreceptor to move the cleaner brush out of direct alignment with the image.

* * * * *